US006073769A

United States Patent [19]

Fulda

[11] Patent Number: 6,073,769

[45] Date of Patent: Jun. 13, 2000

[54] CARD HOLDER AND DISPLAY

[76] Inventor: Chad W. Fulda, 3132 E. 5th St., Lot #60, Superior, Wis. 54880

[21] Appl. No.: 09/148,255

[22] Filed: Sep. 4, 1998

Related U.S. Application Data

[60] Provisional application No. 60/058,076, Sep. 5, 1997.

[51] Int. Cl.[7] ..... B65D 85/48

[52] U.S. Cl. ..... 206/455; 206/748

[58] Field of Search ..... 206/6.1, 308.3, 206/449, 455, 483, 736, 748; 150/145, 147, 149; 383/39, 40

[56] References Cited

U.S. PATENT DOCUMENTS

| | | | |
|---|---|---|---|
| 2,036,341 | 4/1936 | Lemburg . | |
| 2,763,311 | 9/1956 | Sparrow . | |
| 3,069,168 | 12/1962 | Feldman et al. . | |
| 3,334,677 | 8/1967 | Toomey . | |
| 3,435,868 | 4/1969 | Stermer . | |
| 3,565,148 | 2/1971 | Miller | 150/39 |
| 4,629,070 | 12/1986 | Roberg . | |
| 4,979,619 | 12/1990 | Hager | 206/509 |
| 5,159,964 | 11/1992 | Baker et al. | 206/455 |
| 5,224,600 | 7/1993 | Neugebauer | 206/449 |
| 5,291,990 | 3/1994 | Sejzer | 206/743 |
| 5,779,033 | 7/1998 | Roegner | 206/6.1 |
| 5,816,392 | 10/1998 | Kawagoe et al. | 206/455 |

*Primary Examiner*—David T. Fidei
*Attorney, Agent, or Firm*—Douglas J. Christensen

[57] ABSTRACT

A flexible card holder and display which enables a plurality of cards to be attached, transported, displayed, and stored. The card holder comprises a sheet of thin, tear-resistant material into which a plurality of slits have been cut. The slits are arranged so as to receive portion of card, thereby releasably retaining the cards on the sheet. The card holder is lightweight, portable, and foldable into a variety of compact configurations. The card holder may be provided with an aperture at one end to enable the card holder to be suspended, thus displaying cards which are releasably attached thereto.

7 Claims, 3 Drawing Sheets

1
10
11
12
13
13A
13B
13C
13D
14
15
16
17A
17B
17C
17D
18
19
20
21
22
23
30
31
32
33
50A
50B
50C
50D
A
B

CARD HOLDER AND DISPLAY

This is a utility application based on U.S. Provisional Patent Application Ser. No. 60/058,076, filed Sep. 5, 1997.

BACKGROUND OF THE INVENTION

The present invention relates generally to a card transporter and display, and more particularly to a sheet of flexible material which can releasably retain an array of trading card holders.

Trading cards have been in existence for many years. They have been available for sale directly or as premiums associated with other merchandise. Up until recently, trading card collections and collectors have generally been the province of youngsters, and the occasional adult. That has changed. Today, there are serious trading card collectors of all ages who collect premium trading cards. Because of the costs involved, collectors have become more sophisticated and they are likely to purchase trading card holders so that trading cards themselves are not touched by bare hands.

The problem with these holders is that they take up a lot of space and it is difficult to show off one's collection. Also, many collectors travel from trade show to trade show as exhibitors. It takes time to set up and break down a display booth. With existing exhibits, there is always the chance that a trading card may be misplaced and never seen by the public, or worse, lost during the frequent packing and unpacking. Also, there are many people who identify with a particular sport or team. Trading cards may be incidental to them, yet important enough to warrant prominent display in a rec room, or den, for example.

There is a need for a device which can be used to transport, store, and display trading cards in an attractive and easily discerned manner.

SUMMARY OF THE INVENTION

A flexible card transport and display device which enables a plurality of cards to be attached, transported, displayed, and stored. The card transport and display device comprises a sheet of thin, tearresistant material into which a plurality of card holder retaining elements in the form of slits have been cut. The slits are arranged so as to receive the corners of card holders, preferably trading cards which have been placed into transparent trading card holders, thereby releasably retaining the cards on the sheet. The card transport and display device is lightweight, portable, and foldable into a variety of compact configurations.

One embodiment of the card transport and display is provided with an upper support and an aperture at one end to enable the card transport and display to be suspended, thus displaying cards which are releasably attached thereto.

In a second embodiment, the card transport and display does not include the upper support. Thus, when a plurality of cards (i.e., transparent trading card holders with trading cards) are attached to the sheet, a plurality of preferential fold lines are defined. Although the fold lines are orthogonal to the cards, diagonal spacing may be achieved by providing enough space between adjacent cards. Due to the flexible nature of the sheet and the relative widths of the fold lines defined by the cards, the sheet with cards attached may be folded into many configurations.

A principal object and advantage of the present invention is to enable a large number of trading cards to be easily stored.

Another object and advantage of the invention is to enable a large number of trading cards to be easily transported.

Another object and advantage of the invention is to enable a large number of trading cards to be easily displayed.

Yet another object and advantage is the provision of a flexible, tear-resistant backing or sheet onto which trading cards are releasably attached.

Still another object and advantage is the use of the flexible, tear-resistant backing sheet with transparent trading card holders.

Another object and advantage of the invention is the formation of preferential fold lines that occurs when transparent trading card holders are attached to the flexible sheet.

Still another object and advantage is to increase the configurations into which the sheet and the attached transparent trading card holders may be folded.

Still another object and advantage is to enable selective portions of the sheet and attached trading cards to be easily displayed.

Yet another object and advantage is to provide increased protection from the elements when the sheet and trading cards are bundled-up for transport and storage.

These, and other objects, features, and advantages of the invention will become more readily apparent to those skilled in the art from the detailed description and the accompanying drawings.

DETAILED DESCRIPTION

Figures 1, 2, 3:
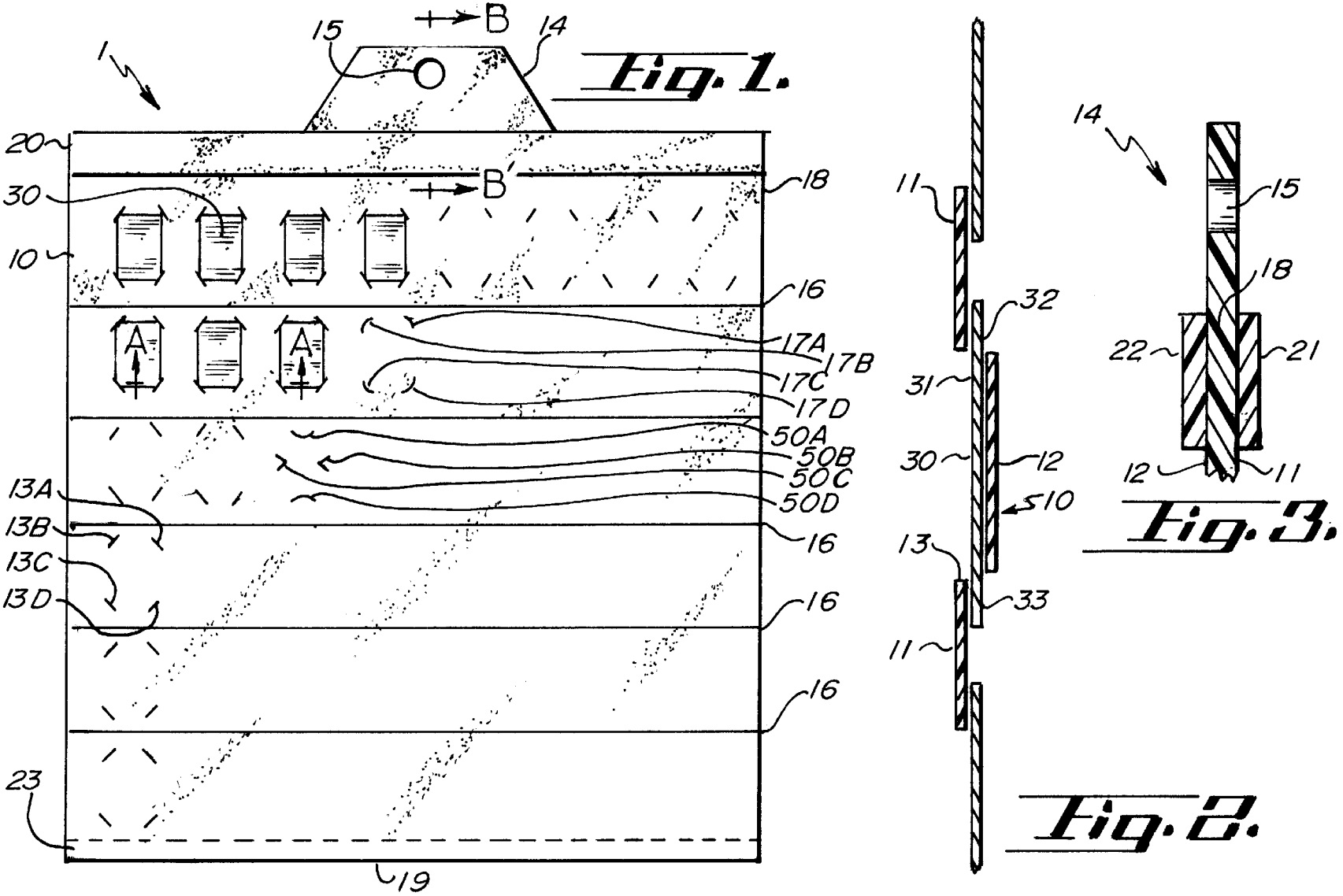
FIG. 1 is plan view of the invention.
FIG. 2 is a cross-sectional view taken along line A—A' of FIG. 1.
FIG. 3 is a cross-sectional view taken along line B—B' of FIG. 1.

Referring to FIGS. 1 through 4, the card transport and display device is shown and is generally designated with the numeral 1. The card holder 1 generally comprises a sheet or backing 10 into which a plurality of slits 13 have been cut. The slits are sized and arranged such that portions of a card holder 30 project therethrough, thereby releasably retaining the card holder to the sheet or backing 10. The sheet or backing 10 is provided with a tab 14 which extends beyond a first end 18, with the tab having an aperture 15 therethrough to enable the sheet to be suspended. The sheet is also provided with an upper support 20 adjacent the tab 14 which serves to prevent upper edges of the sheet from curling downwardly when the card transport and display device is suspended. The upper support 20 extends generally along the length of the first end 18 such that the entire width of the sheet or backing 10 is uniformly suspended. The upper support 20 also serves to reinforce the card transport and display device when it has been furled or folded into a bundle for transport or storage.

Turning to FIG. 1, card transport and display device 1 comprises a sheet or backing 10 which has a front facing side 11 and a rear facing side (not shown). Although the sheet 10 is preferably made from a commercially produced vinyl laminated polyester under the name Protexit™, manufactured by the John Boyle & Company, Inc., Statesville, N.C.; other tear resistant material may be used. The sheet 10 is provided with a plurality of slits 13A–D and 17A–D, for example which serve to releasably retain a card holder 30. The slits sized and arranged to admit corners or projections 33 of a card 30.

For purposes of clarification in this application, the term "card" holder is construed to mean a generally planar article which may be adapted to releasably contain a generally flat article, wherein the generally flat article is a trading card, a data storage disc, or the like. In that vein, the preferred "card" holder of this invention is a transparent, relatively rigid sleeve sized to receive and retain a trading card.

The shape of the slits need not be straight as in 13A–D, but may be arcuate 17A–D if desired. The number of slits 13 can vary, according to the shape of the card holder to be releasably retained. For example, a card holder which has the outline of a star with five arms or projections would be provided with five slits, even though each arm need be inserted into each slit to retain the card holder to the sheet. If desired, however, three slits would suffice. In this preferred embodiment, however, the card holder 30 which are releasably retained onto the sheet or backing 10 are rectangular. Note that the slits 13A–D and 17A–D are preferably arranged such that they releasably retain card holder in an array of rows and columns, with the rows separated by, and which define a plurality of parallel lines 16 about which the sheet 10 with card holder attached thereto, may be folded.

In an alternative embodiment, a plurality of slits are sized and arranged such that a plurality of projections 50A, 50B, 50C, and 50D are formed. When this embodiment is used, the projections 50A, 50B, 50C, and 50D are arranged in such a fashion that they overlay portions of a card holder, thus releasably retaining a card holder to the sheet or backing 10.

The sheet or backing 10 may also be provided with a lower support 23 (shown in dashed lines) which is adjacent the second end 19 of sheet 10. The lower support 23 serves to prevent lower edges of the sheet from curling and adds rigidity to the card transport and display device when it is furled or folded for transport or storage. The structure of the lower support 23 is the same as the structure of the upper support 20 which is depicted in FIG. 3 and described below. Therefore, it will not be depicted and further described.

Referring to FIG. 2, the juxtaposition between the sheet or backing 10 and card holder 30 may be more easily seen. To retain a card holder 30 as shown in FIG. 1 onto the sheet or backing 10, the corners or projections 33 of the card holder 30 are inserted into corresponding slits 13A–D or 17A–D such that the corners or projections 33 of the front facing side 31 of the card holder 30 are adjacent the rear facing side 12 of the sheet, and the rear facing side 32 of the card holder 30 is adjacent the front facing side 11 of the sheet or backing 10.

Referring to FIG. 3, the structure of the upper support 20 may be more easily seen. The sheet or backing 10 is provided with a tab 14 at one end thereof, with the tab having an aperture 15 therethrough to enable the sheet to be suspended. The sheet is also provided with an upper support 20 adjacent the tab 14 which serves to prevent upper edges of the sheet from curling downwardly when the card transport and display device is suspended. The upper support 20 comprises a front facing slat 21 and a rear facing slat 22 which are affixed adjacent the first end 18 of the sheet 10, on the front facing side 11 and the rear facing side 12, respectively. In the alternative, backing sheet 10 may be provided with a sleeve into which a slat may be removably inserted (not shown). Although the use of two slats is depicted, it is understood that one of the slats may be omitted if desired. As depicted in FIG. 1, note that the support is parallel to the lines 16 about which the sheet or backing 10 is folded.

Figure 4:
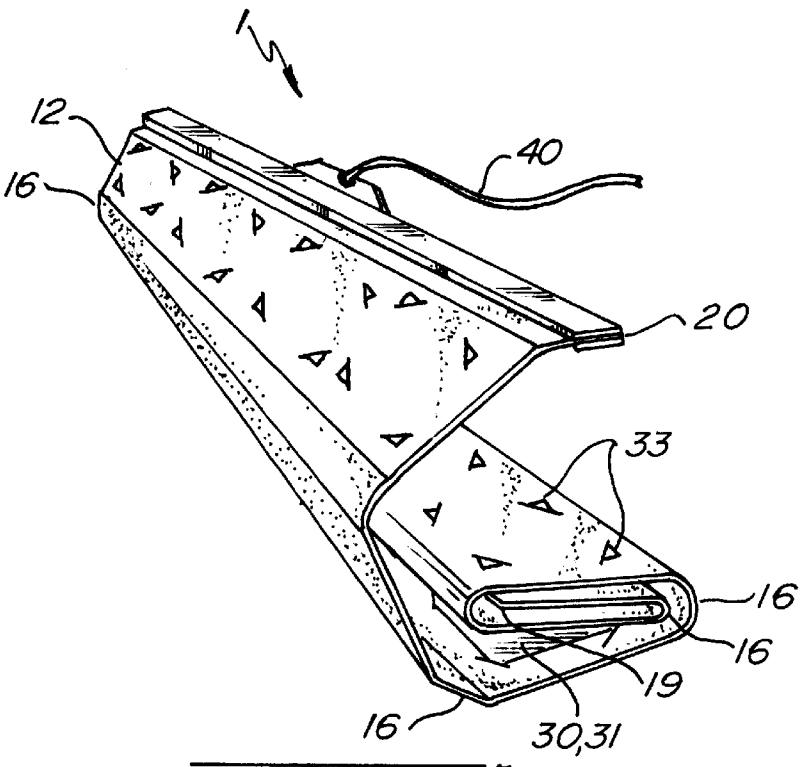
FIG. 4 is a perspective view of the invention in a partially folded state.

Referring to FIG. 4, the card transport and display device 1 is in a partially folded state. Here, the sheet or backing 10 has been partially folded or furled about lines 16 in a circular fashion. Preferably, the folding or furling operation starts at the second end 19 of the sheet 10 wherein the front facing side of the sheet 11 is folded against itself. As shown in the figure, the front sides 31 of cards 30 are thus protected. Note that as the first end of the sheet or backing is folded into position, only the corners or projections 33 of cards 30 are visible from the rear facing side 12 of the sheet. Although the sheet in this embodiment is furled, it is understood that other methods of folding the sheet may be employed without departing from the spirit and scope of the invention.

Referring to FIGS. 1–4, the operation will now be discussed. In use, the card transport and display device 1 is unfolded or unfurled to expose a front facing side 11. A card holder or card holders 30 are then attached to the sheet 10 by inserting the corners or projections 33 of the card holders into slits 13A–D, 17A–D. If the card holder or cards are to be displayed, the card transport and display device may be suspended by utilizing the aperture 15, in tab 14 which extends from a first end 18 of the sheet 10. If the card holder or card holders are to be stored or protected, the sheet is preferably furled along lines 16 starting at a second end 19 of the sheet. As the tab 14 is furled about the body of sheet 10, the resulting bundle may be secured with a closure 40.

Referring to FIGS. 5 and 6A through 6D, the card transport and display device is shown and is generally designated with the numeral 100. The card transport and display device 100 generally comprises a sheet or backing 110 into which a plurality of slits 120, 122, 124, and 126 have been cut. The slits are sized and arranged such that portions of a card holder 130 project therethrough, thereby releasably retaining the card to the sheet or backing 110. Preferably, slits 120, 122, 124, 126 are arranged to enable an array of cards in card holders to be displayed in a plurality of rows (162, 164, 166, 168) and columns (171, 173, 175, 177) with the rows and columns separated by, and which define, parallel fold lines 140, 150.

Although a four-by-four matrix is shown, it is understood that additional rows and columns may be provided to enable a larger array of cards in card holders to be displayed; for example, an entire athletic team.

Figure 5:
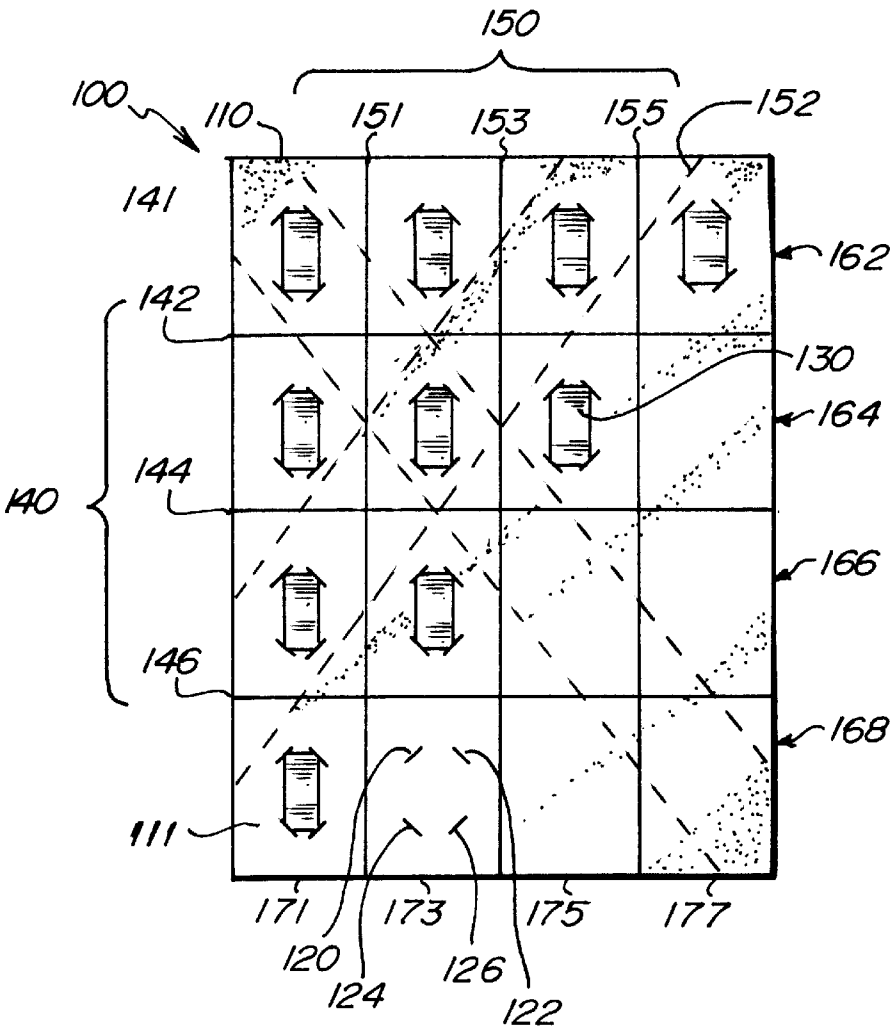
FIG. 5 is a plan view of a second embodiment of the invention.

Referring to FIG. 5, card transport and display device 100 comprises a sheet or backing 110 which has a front facing side 111 and a rear facing side 112 (not shown). As mentioned above, sheet 110 is preferably made from a vinyl laminated polyester known commercially as name Protexit™. However, other tear-resistant material may be used. As with the first embodiment of FIGS. 1–4, sheet 110 is provided with a plurality of slits 120, 122, 124, 126, which serve to releasably retain a card 130. The slits are sized and arranged to admit corners or projections of a card 130, as described and shown above in FIGS. 1 and 4.

As with the first embodiment shown and described above, the shape of the slits need not be straight as depicted in 120–126, but may be arcuate if desired. Additionally, the number of slits can vary, according to the shape of the card holder to be releasably retained. Note that the slits 120–126 are preferably arranged such that they create a plurality of parallel lines 142, 144, 146, and 151, 153, 155 about which the sheet 110 with cards attached thereto, may be folded.

With regard to the arrangement of the slits, it is envisioned that such arrangement may take other forms. So, for example, spacing between the groups of slits may be increased to enable the cards of the card transport and display device to define a plurality of additional, diagonal fold lines. Additionally, the groups of slits may be arranged along curved portions such as circles and waves instead of the preferred linear arrangement. And, although the preferred embodiment depicts rectangularly-shaped card holders in a vertical orientation, it is envisioned that the card holders may be oriented horizontally, if desired.

Figure 6A:
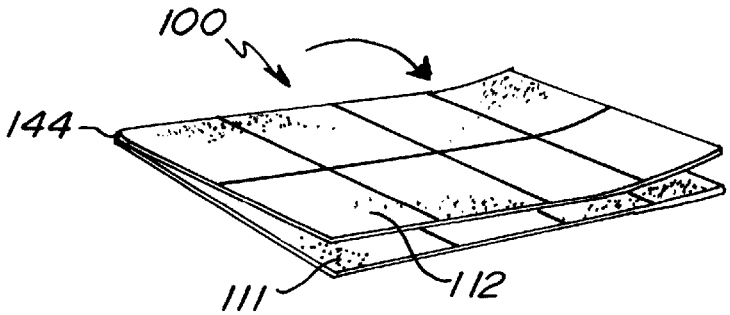
FIGS. 6A to 6D depict the second embodiment of FIG. 5 as it is folded into a compact form.
Figure 6B:
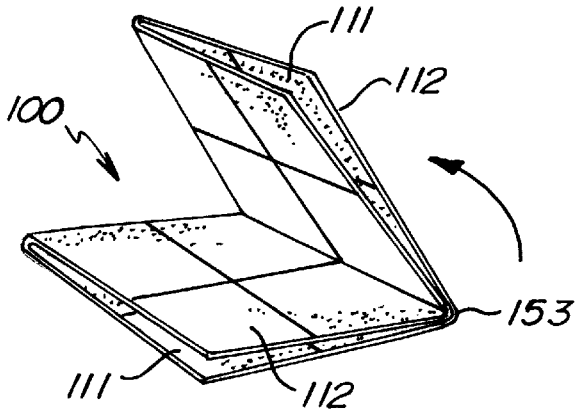
Figure 6C:
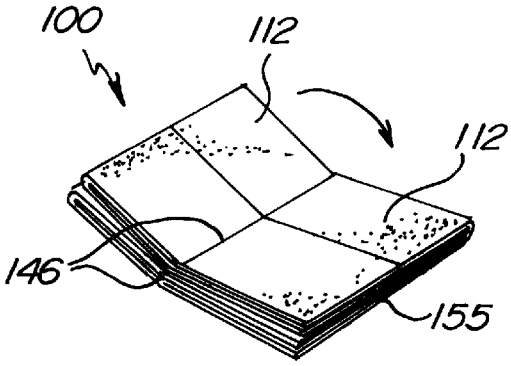
Figure 6D:
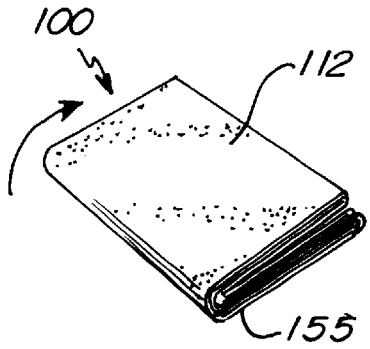

Referring to FIGS. 6A through 6D, the operation will now be discussed. These figures indicate one of many configurations into which the card transport and display device may be folded. Note that card holders and slits are not depicted. In this particular sequence, the rear facing side 112 is in a position where card holders are protected by sheet 110. To form this particular bundle, card holder 100 is folded about line 144 so that the card transport and display device is halved FIG. 6A. In FIG. 6B, the card transport and display device is folded about line 153 so that the card transport and display device is again halved. In FIG. 6C, the card transport and display device is folded about line 146 so that the card transport and display device is halved again. Lastly, in FIG. 6D, the card transport and display device is folded about line 155 so that the card transport and display device is in a compact form for transportation and/or storage. As with the first embodiment, the transport/storage package may be provided with a closure (not shown), and/or a protective container (also not shown).

Although the aforementioned figures depict a configuration which is folded symmetrically to produce a card transport and storage package, it is understood that other folding configurations may by used. For example, the folds may be asymmetrical so that selected portions of the front facing surface of the card transport and display device display may be displayed. Or, the card transport and display device may be folded accordion-style; furled along a column or row; or folded using a combination of furls and folds.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

I claim:

1. A card transport and display device in combination with a plurality of transparent card holders, the card holders each having four corners and sized to receive and retain trading cards, the device comprising a sheet of flexible material, the sheet having a plurality of slits, each slit positioned to receive one of the four corners of the plurality of the card holder and the slits further positioned such that each corner of each card holder may be received thereby retaining the card holder in the sheet material, the slits positioned to arrange the card holders in a plurality of rows with a fold line being defined intermediate each row, whereby the sheet material with the card holders retained thereby may be folded up.

2. The card transport and display device of claim 1 wherein the slits are further positioned such that the card holders retained therein define a plurality of columns with a fold line being defined intermediate each column.

3. The card transport and display device of claim 1 wherein the sheet material has an upper end width a width and further comprises a support extending the width of the sheet whereby the entire width of the sheet may be suspended.

4. The card transport and display device of claim 1 further comprising a tab at the upper end with an aperture therein for hanging the device.

5. A card transport and display device in combination with a plurality of transparent card holders, the card holders each having four corners and sized to receive and retain trading cards, the device comprising a sheet of flexible material, the sheet having a plurality of slits, each slit positioned to receive one of the four corners of the plurality of the card holders and the slits further positioned such that each corner of each card holder may be received thereby retaining the card holder in the sheet material, the slits positioned to arrange the card in a plurality of columns with a fold line being defined intermediate each column, whereby the sheet material with the card holders retained thereby may be folded up.

6. The card transport and display device of claim 5 wherein the slits are further positioned such that the card holders retained therein define a plurality of rows with a fold line being defined intermediate each column.

7. A method of transporting a plurality of card holders, the transparent card holders having four corners and each card holder configured to retain and display a trading card, the method comprising the steps of:

a) providing a sheet of flexible material with a plurality of slits arranged to receive the corners of the card holders, each slit receiving only one corner of one card holder, the slits arranged to position the plurality of card holders in an array with at least one of a plurality of rows and a plurality of columns;

b) inserting a plurality of card holders in the slits to define a plurality of fold lines between the at least one of a plurality of rows and a plurality of columns; and c) folding the sheet material with the card holders at the fold lines to form a compact bundle.

* * * * *